US008734195B2

(12) United States Patent
Coombs et al.

(10) Patent No.: US 8,734,195 B2
(45) Date of Patent: May 27, 2014

(54) MOORING BUOY ASSEMBLY

(75) Inventors: David Coombs, LaGrange, IL (US); Paul LaMourie, Naperville, IL (US); Kelly Briscoe, Chicago, IL (US)

(73) Assignee: Great Lakes Dredge & Dock Company, LLC, Oak Brook, IL (US)

( * ) Notice: Subject to any disclaimer, the term of this patent is extended or adjusted under 35 U.S.C. 154(b) by 160 days.

(21) Appl. No.: 13/283,826

(22) Filed: Oct. 28, 2011

(65) Prior Publication Data

US 2013/0109258 A1 May 2, 2013

(51) Int. Cl.
*B63B 22/02* (2006.01)

(52) U.S. Cl.
USPC ..... 441/5

(58) Field of Classification Search
USPC ..... 114/264; 405/205, 211, 217; 441/3, 4, 5
See application file for complete search history.

(56) References Cited

U.S. PATENT DOCUMENTS 3,465,374 A * 9/1969 Johnson et al. ..... 441/4
3,945,066 A * 3/1976 Davies ..... 441/5
3,979,785 A * 9/1976 Flory ..... 441/5
6,558,215 B1 * 5/2003 Boatman ..... 441/5
7,029,348 B2 * 4/2006 Bauduin et al. ..... 441/4
7,993,176 B2 * 8/2011 Lunde ..... 441/5
8,231,420 B2 * 7/2012 Lunde ..... 441/5

OTHER PUBLICATIONS

"A Single-Point Mooring System for Direct Pump out of Hopper Dredges," Dredging Research Technical Notes, U.S. Army Engineer Waterways Experiment Station, Nov. 1992.
"Hull Structure and Anchor Handling," Technical Drawing, Design Associates, Inc. Drawing No. C-1264-2, Dec. 15, 1976.
"Single Point Mooring System," Bluewaters Calm Buoy, video on DVD, Bluewater, Aug. 16, 2011.
"Outboard Profiles and a Deck Plan," Technical Drawing, Design Associates, Inc. Drawing No. C-12G4-1, Dec. 21, 1976.

* cited by examiner

*Primary Examiner* — Lars A Olson
(74) *Attorney, Agent, or Firm* — Foley & Lardner LLP

(57) ABSTRACT

A mooring buoy assembly includes a floating structure, a pipe, an elbow, and a swivel joint. The pipe extends vertically into and away from the floating structure, and is fixed to the floating structure such that the floating structure does not rotate with respect to the pipe. Furthermore, the pipe is configured to provide a flow path in fluid communication with a submerged hose. The elbow is in fluid communication with the pipe and provides a change in direction of the flow path. Furthermore, the elbow is supported by the floating structure and is configured to be in fluid communication with a floating hose. The swivel joint is connected to the pipe and is configured to allow the elbow and floating hose to rotate relative to the submerged hose.

20 Claims, 8 Drawing Sheets

MOORING BUOY ASSEMBLY

FIELD OF THE INVENTION

The present disclosure relates generally to a mooring buoy assembly for a riser system, which includes a mooring pontoon. More specifically, the present disclosure relates to a mooring pontoon that, together with floating and submerged discharge hoses, is configured to connect a hopper dredge or another vessel to an underwater pipeline for direct discharge of dredged slurry or other materials to shore.

BACKGROUND

A single-point mooring provides an offshore unloading point for a ship to transfer generally-fluid materials to shore, such as oil, slurry, etc. In some instances, a single-point mooring, such as a catenary anchor leg mooring buoy, may be used to provide an offshore unloading point for a ship or dredger, where the vessel approaches and engages an inlet connector of a floating hose, which is in turn connected to the mooring buoy. Material is then pumped into the floating hose and directed to an undersea pipeline via a submerged hose extending from the buoy to the pipeline.

Approaching the single-point mooring may be difficult for a vessel, particularly in rough seas. Currents or other ocean forces (e.g., winds, tides) may vary from location to location and may be difficult for a large vessel carrying a heavy load to maneuver. Some mooring buoys allow for "weathervaning" of vessels about the mooring buoy while the vessel is discharging. However, because the mooring buoys are often designed to be moored in a single location for a period of years, they have large, complicated structures and are expensive to build, deploy, and maintain.

SUMMARY

One embodiment relates to a mooring buoy assembly configured for connecting a vessel to a pipeline for communication of fluid. The mooring buoy assembly includes a pontoon, an elbow supported by the pontoon, and a turning gland positioned under the pontoon. The elbow has an arcuate flow path and is configured to be coupled to a floating hose for connecting to the vessel. The turning gland is in fluid communication with the elbow and is configured to be coupled to a submerged hose coupled to the pipeline. The turning gland is configured to allow the elbow, the pontoon, and the floating hose to rotate relative to the submerged hose. Accordingly, the floating hose may be drawn in the direction of a current such that the vessel may approach the floating hose with a bow of the vessel oriented into the current to engage the mooring buoy assembly.

Another embodiment relates to a mooring buoy assembly comprising a floating structure, a pipe, an elbow, and a swivel joint. The pipe extends vertically into and away from the floating structure, and is fixed to the floating structure such that the floating structure does not rotate with respect to the pipe. Furthermore, the pipe is configured to provide a flow path in fluid communication with a submerged hose. The elbow is in fluid communication with the pipe and provides a change in direction of the flow path. Furthermore, the elbow is supported by the floating structure and is configured to be in fluid communication with a floating hose. The swivel joint is connected to the pipe and is configured to allow the elbow and floating hose to rotate relative to the submerged hose.

Yet another embodiment relates to a mooring buoy assembly comprising an elbow, a swivel joint in fluid communication with the elbow, and a buoyant structure supporting the elbow. The elbow has an arcuate flow path and is configured to be coupled to a floating hose. The swivel joint is configured to be coupled to a submerged hose, and is further configured to allow the elbow and the floating hose to rotate relative to the submerged hose. The buoyant structure has buoyancy sufficient to float the elbow only partially above water.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
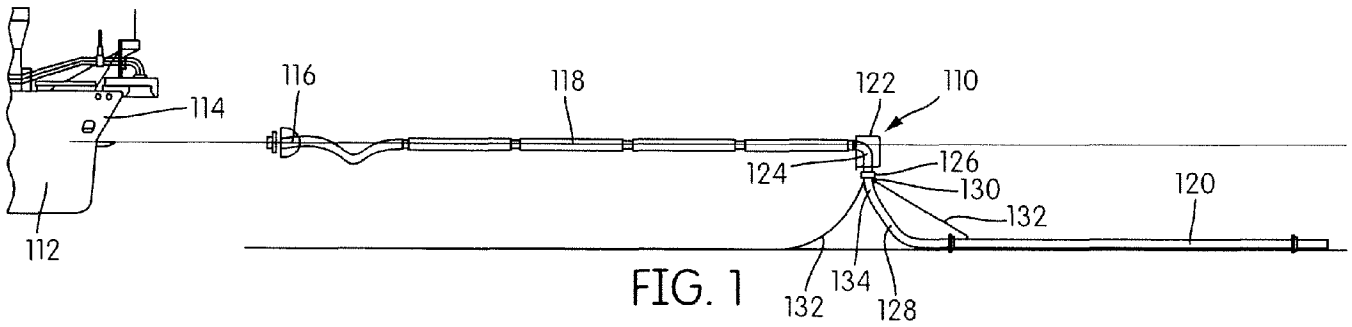
FIG. 1 is side view of a vessel and an undersea pipeline connected via a mooring buoy assembly according to an exemplary embodiment.
Figure 2:
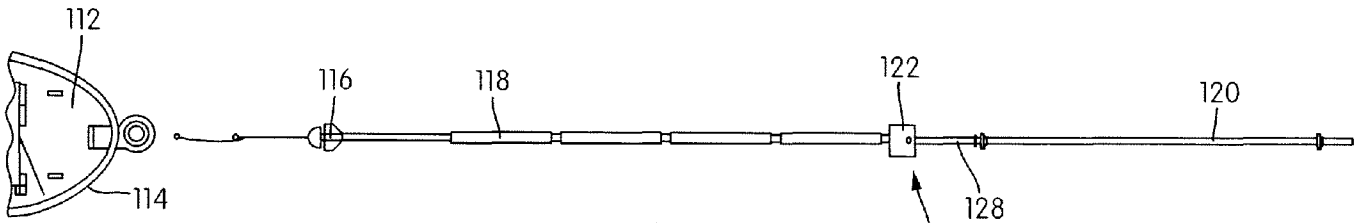
FIG. 2 is a top plan view of the vessel, pipeline, and mooring buoy assembly of FIG. 1.

Referring to FIGS. 1-2, the bow 114 of a vessel, shown in FIGS. 1-2 as a hopper dredge 112, is oriented into a sea current to engage a connector 116 on a distal end of a floating hose 118 (e.g., a discharge hose or conduit). The floating hose 118 is connected to a mooring buoy assembly 110, which serves as part of a riser system connecting the hopper dredge 112 to an undersea pipeline 120 (a steel discharge pipeline in a particular embodiment). The pipeline 120 then carries the discharged materials directly to shore. In some contemplated embodiments, the pipeline 120 provides fluid to the vessel, such as pressurized water or fuel. Embodiments of the mooring buoy assembly 110 may be used in oceans, seas, lakes, rivers, or other bodies of water.

Figure 4:
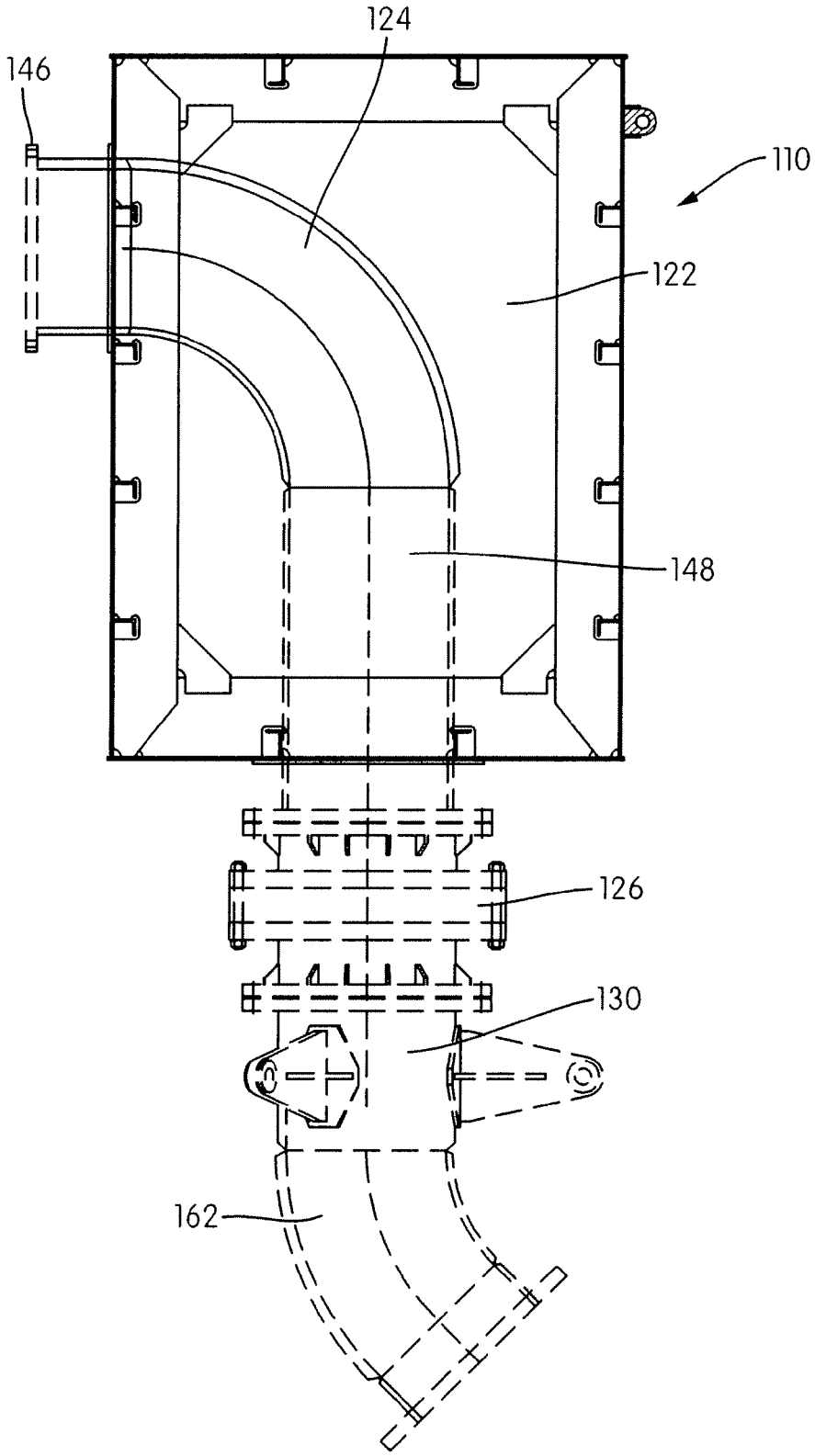
FIG. 4 is a sectional side view of the mooring buoy assembly of FIG. 1.
Figure 5:
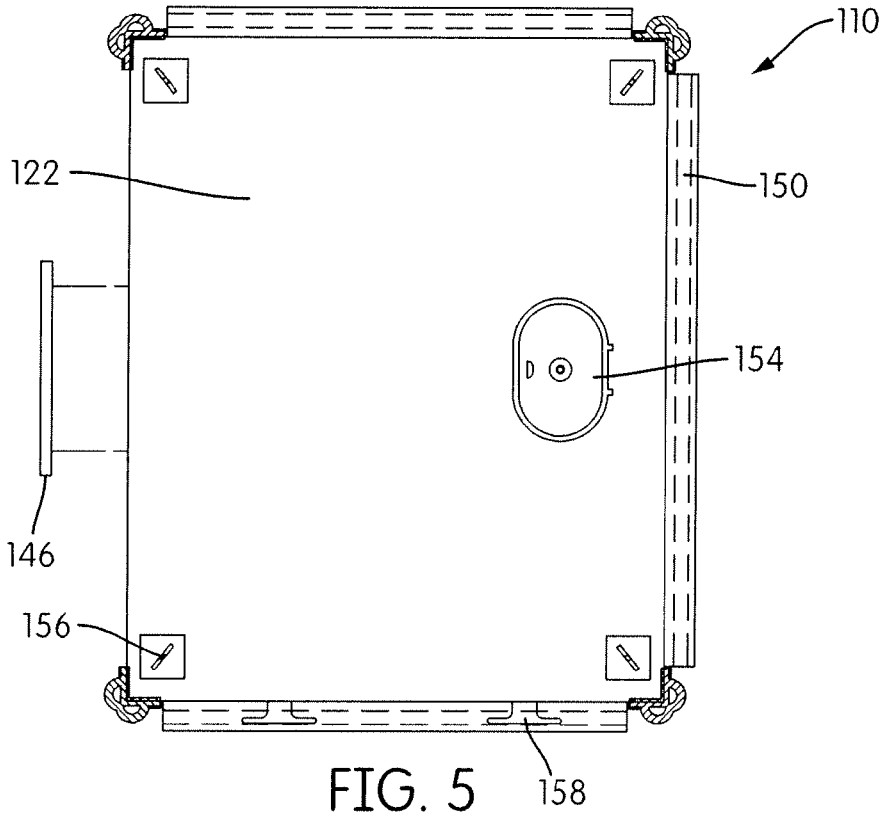
FIG. 5 is a top plan view of the mooring buoy assembly of FIG. 1.
Figure 6:
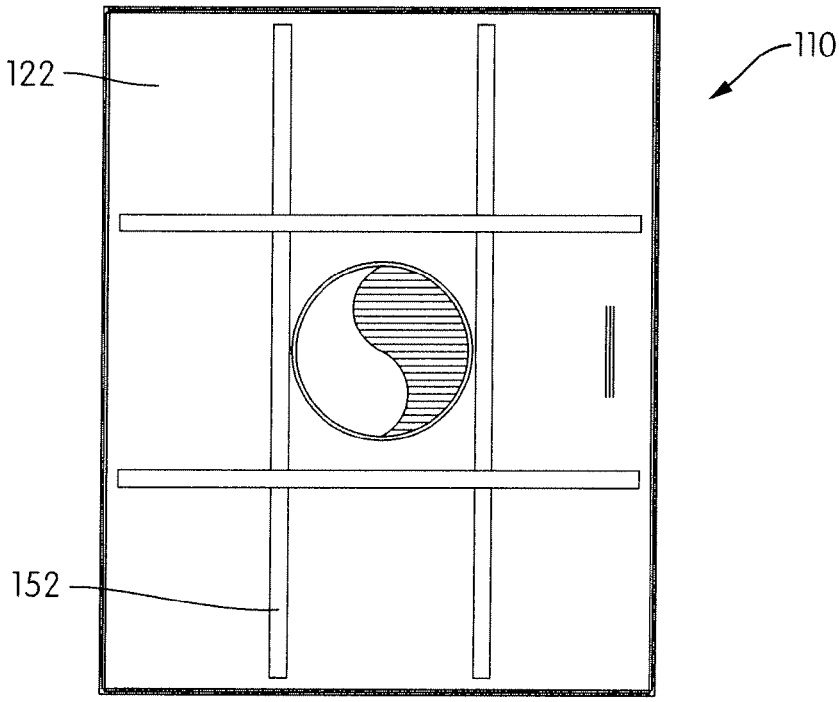
FIG. 6 is a bottom plan view of the mooring buoy assembly of FIG. 1.
Figure 7:
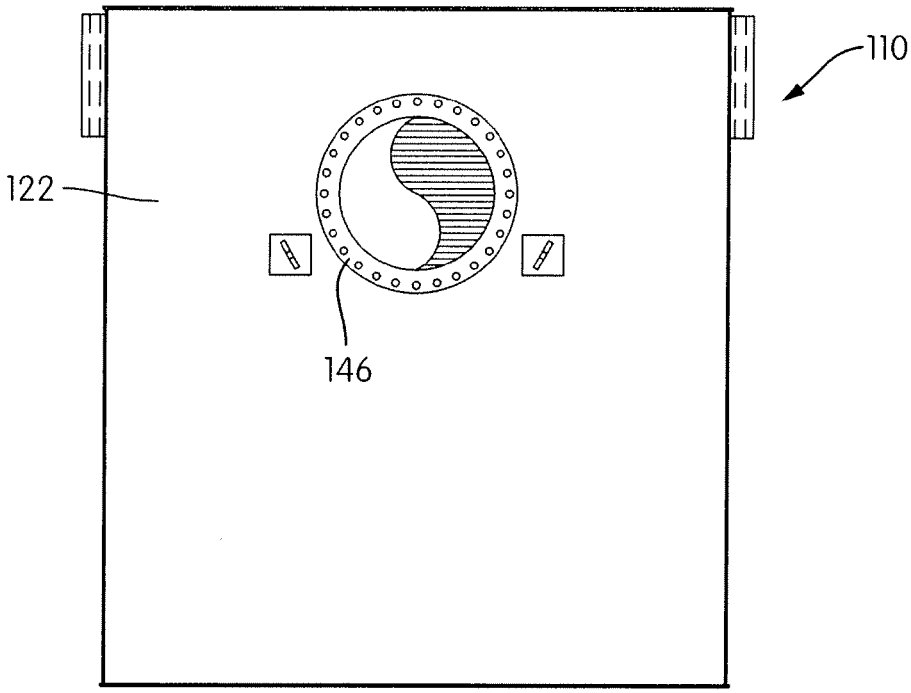
FIG. 7 is a front view of the mooring buoy assembly of FIG. 1.
Figure 8:
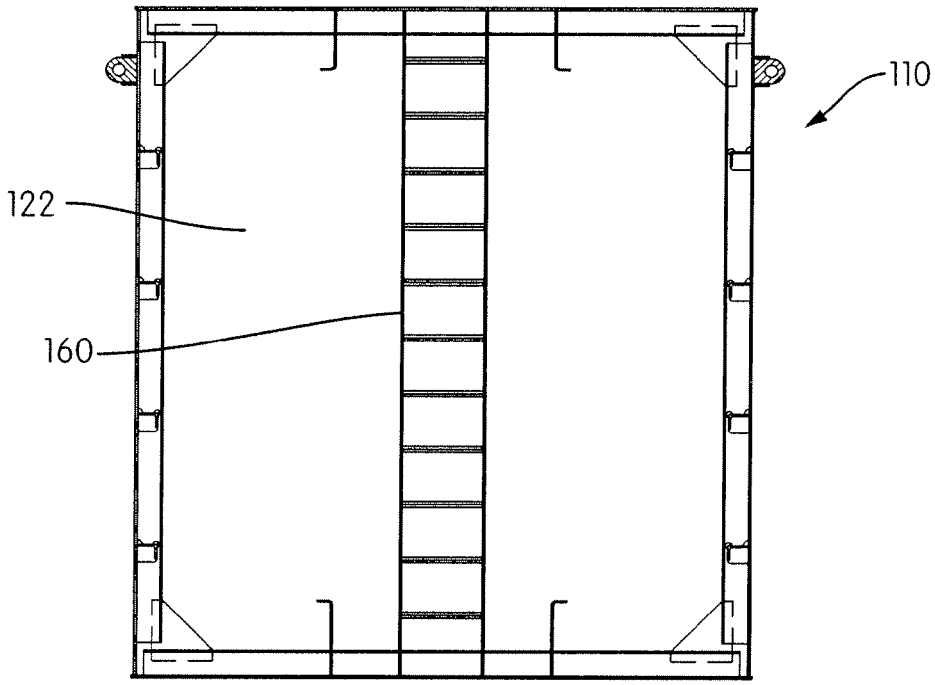
FIG. 8 is a sectional rear view of the mooring buoy assembly of FIG. 1.

According to an exemplary embodiment, the mooring buoy assembly 110 includes a floating structure (e.g., a float or a buoyant component of a buoy), in the form of a pontoon 122, an elbow 124 (e.g., a slurry elbow, elbow fitting or pipe bend), and a swivel joint in the form of a turning gland 126 that allows for rotation of one section of the turning gland 126 relative to another section of the turning gland 126 (also shown in FIG. 4). In some embodiments, one end of the elbow 124 is coupled (directly or indirectly) to the floating hose 118, and the other end of the elbow 124 is coupled to a submerged hose 128 by way of the turning gland 126. In contemplated embodiments, the mooring buoy assembly 110 may include two or more floating hoses 118 and two or more submerged hoses 128 that may operate independently of one another, in conjunction with one another, such as in parallel or tandem with one another, or otherwise. Such a mooring buoy assembly 110 may receive fluid from one or more hoses and contemporaneously provide fluid via one or more additional hoses.

Referring still to FIGS. 1-2, the turning gland 126 is particularly configured with a sufficiently low-friction bearing and horizontal orientation, among other features, to allow the elbow 124 and floating hose 118 to rotate relative to a submerged hose 128 and to be drawn by the sea current. Thus, the hopper dredge 112 may orient and move directly opposite to the current to engage the connector 116 of the floating hose 118. Approaching the floating hose 118 from down-current, because the turning gland 126 and elbow 124 allow floating hose 118 to be drawn by the current, may be more convenient for the hopper dredge 112 shown in FIGS. 1-2 (e.g., easier to navigate, easier to maneuver) when compared to buoy systems having a hose or other connector not configured to rotate about a swivel joint and be drawn by the current.

For purposes of context, a typical hopper dredge may approach a mooring buoy for discharge about eight to ten times per day. Due to navigational and maneuvering advantages associated with approaching the mooring buoy assembly 110 from down-current, the hopper dredge 112 may save about ten minutes per trip to the mooring buoy assembly 110 relative to buoy systems with connectors that do not rotate to be oriented with current. According to this estimate, during the course of a several-week dredging operation the time savings associated with the mooring buoy assembly 110 of FIG. 1 may amount to net time savings on the order of days, which is a considerable amount of time for a large dredging operation and may equate to substantial savings in fuel, monetary cost, manpower, equipment wear, and other factors.

Figure 9:
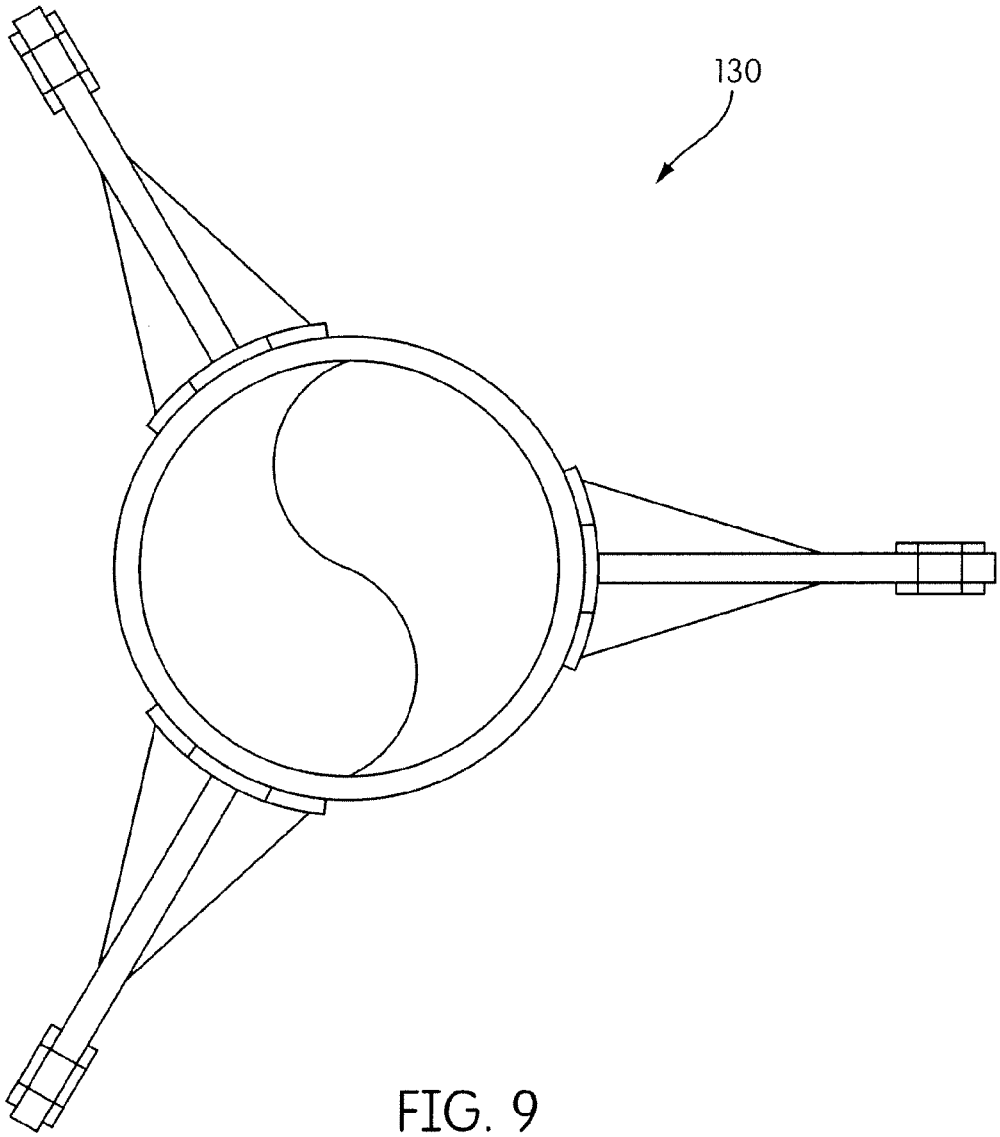
FIG. 9 is a top plan view of an anchor ring of the mooring buoy assembly of FIG. 1.

While the floating hose and elbow are free to rotate about the turning gland 126 (e.g., rotating part), the mooring buoy assembly 110 may further include components that are rotationally-constrained (e.g., "fixed" part) on the opposite side of the turning gland 126. According to an exemplary embodiment, the mooring buoy assembly 110 includes an anchor ring 130 (or other attachment structure) on the side of the turning gland 126 opposite to the elbow (see also FIG. 9). The anchor ring 130 is configured to receive chains 132 or similar fastening devices for anchoring the mooring buoy assembly 110 to the seafloor or the pipeline 120. The chains 132 may be somewhat loose hanging (e.g., catenary) from the anchor ring 130 so that the mooring buoy assembly 110 has leeway to move within a generally-constrained location (e.g., within a 250 sq-ft area of the water surface). Below the anchor ring 130, the mooring buoy assembly 110 is connected to the submerged hose 128.

Figure 3:
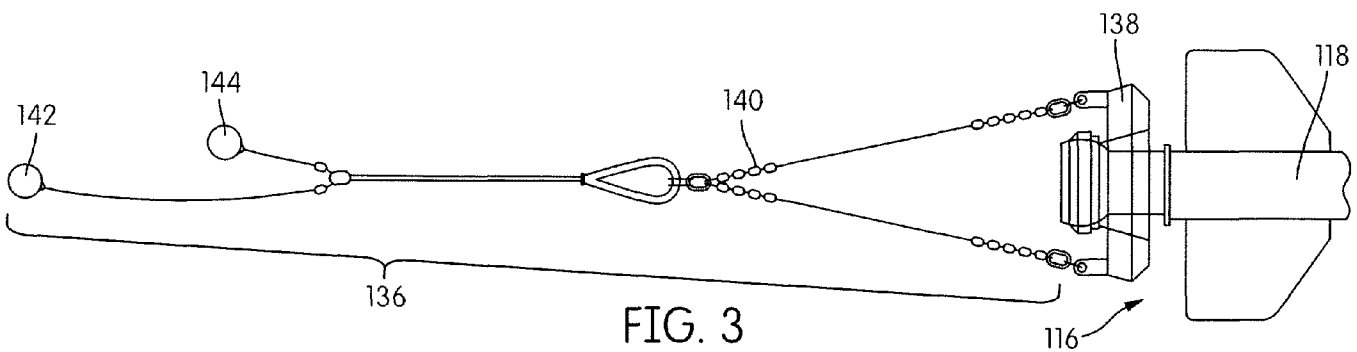
FIG. 3 is a top plan view of a connector of a floating hose of the mooring buoy assembly of FIG. 1.

Referring to FIG. 3, the floating hose 118 includes the connector 116 (e.g., probe), which is design to facilitate engagement and control of the floating hose 118 by a vessel. According to an exemplary embodiment, the connector 116 includes rigging 136 (e.g., probe rigging) that includes a collar 138 and chains 140 that are connected to spherical or otherwise-shaped markers 142, 144. In some embodiments, only one 142 of the markers 142, 144 floats (e.g., is inflated). According to an exemplary embodiment, the vessel includes a corresponding rigging (e.g., dredge rigging) designed to engage the rigging 136 of the connector 116. In some embodiments, the rigging 136 of the vessel includes a hook that extends from the bow to catch one or both of the markers 142, 144 and to then draw in the connector 116. In other embodiments, other forms of connectors and riggings may be used.

Referring to FIGS. 4-9, the mooring buoy assembly 110 includes the elbow 124 integrated with the floatation pontoon 122. According to an exemplary embodiment, one end of the elbow 124 extends to (and from) a side of the pontoon 122. A flange 146 on the end of the elbow 124 is configured to couple to the floating hose 118 (or an intermediate fitting) via a flange coupling. The other end of the elbow 124 extends to a pipe 148 (e.g., vertical pipe; turret). In some embodiments, the elbow 124 is connected to the pipe 148 via a flange coupling or another connection (see generally FIG. 11). In other embodiments, the elbow 124 and pipe 148 are integrally connected, such as being portions of the same body or welded together.

According to an exemplary embodiment, the elbow 124 rotates with respect to the pipe 148. In some such embodiments, the pipe 148 is further fixed to the pontoon 122 such that the pontoon 122 does not rotate with respect to the pipe 148. Fixing the pipe 148 to the pontoon 122, instead of allowing the pontoon 122 to rotate about the pipe 148, is believed to greatly simplify the design of the mooring buoy assembly 110 because bushings, bearings, seals, grease, anti-corrosion coatings, and other rotational elements and associated features may be eliminated between the pipe 148 and the pontoon 122. Instead, the pipe 148 is rigidly fastened to the pontoon 122 and simply provides a flow path through the pontoon 122 from the floating hose 118 and elbow 124 to the submerged hose 128 below the pontoon 122. In other contemplated embodiments, the pipe 148 is not fixed to the pontoon 122, and the pontoon 122 is configured to rotate with respect to the pipe 148.

According to an exemplary embodiment, the elbow 124 is connected to the flow path above the turning gland 126, and a second elbow 162 is connected to the flow path on the opposite side of the turning gland 126. As such, the turning gland 126 is connected to the submerged hose by way of the second elbow 162, which may help prevent pinching or over-bending and constriction of the submerged hose 128. In some embodiments, the second elbow 162 changes the direction of flow via an arcuate bend (e.g., smooth, continuously turning, constant-radius, bend) that is less than a similar arcuate bend of the other elbow 124, such as about half of the magnitude (e.g., about 45-versus 90-degrees). In particular embodiments the radius of curvature of the elbow may be less than about 50 feet (about 47 feet in one embodiment). The elbow 124 and the second elbow 162 may bend at the same radius of curvature or at different radii. In some embodiments, the elbow 124 may be formed from two second elbows 162 fastened together.

Still referring to FIGS. 4-9, the pontoon 122 of the mooring buoy assembly 110 is generally rectangular or box-shaped. Such a shape may be convenient for shipping or transportation of the pontoon 122 (see generally FIG. 10). However, in other embodiments, a pontoon may be pill-shaped, cylindrical, or otherwise shaped. In still other embodiments, two or more pontoons may be used to support the elbow 124 and to float the end of the submerged hose 128. Additionally, the mooring buoy assembly 110 may further include bumpers 150 (FIG. 5), gratings 152 (FIG. 6), a hatch 154 (FIG. 5), loops 156 (FIG. 5), cleats 158 (FIG. 5), a ladder 160 (FIG. 8), beacons, visual reflectors, a winch, counterweights, ballast, pumps for adjusting buoyancy, and other features generally associated with buoys, moorings, and nautical vessels.

Figure 10:
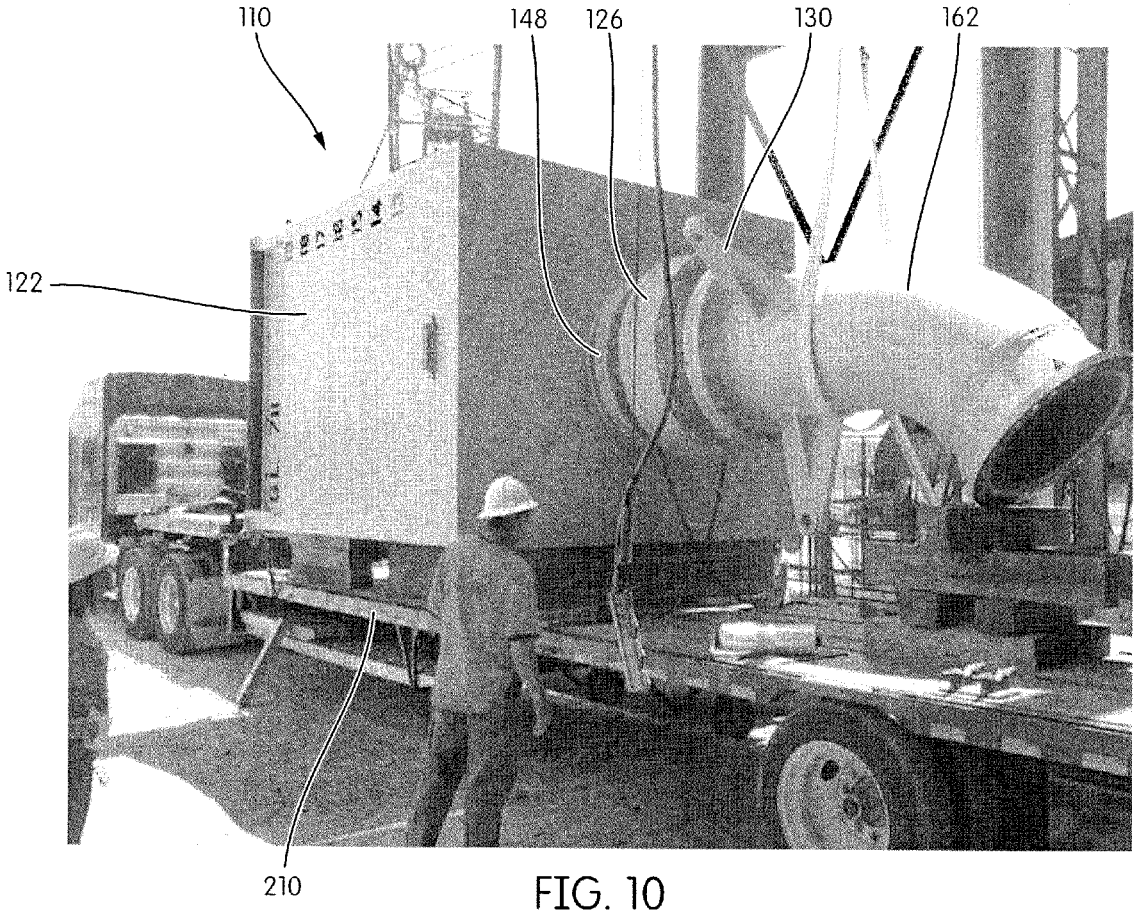
FIG. 10 is a digital image of a mooring buoy assembly on the trailer of a semi-truck according to an exemplary embodiment.

As shown in FIG. 10, the mooring buoy assembly 110 is sized to be transportable via a standard trailer 210 of a semi-truck or rail car (e.g., 28 foot trailer, 48-foot trailer). In a particular embodiment, the pontoon 122 of the mooring buoy assembly 110 is about ten feet long with eight-foot square ends, and the volume of the pontoon 122 is less than 1000 cubic feet, such as less than 800 cubic feet. The pipe 148, turning gland 126, anchor ring 130, and secondary elbow 162 extend lengthwise from the bottom of the pontoon 122 by about another ten feet. Accordingly, the size of the pontoon 122 may provide substantial advantages for transportation and manufacturing, allowing more of the mooring buoy assembly 110 to be assembled prior to fielding, requiring lighter cranes, requiring less materials, etc., when compared to other mooring buoy assemblies, which may be considerably larger. In other contemplated embodiments, the mooring buoy assembly 110 is larger than 1000 cubic feet in volume.

Figure 11:
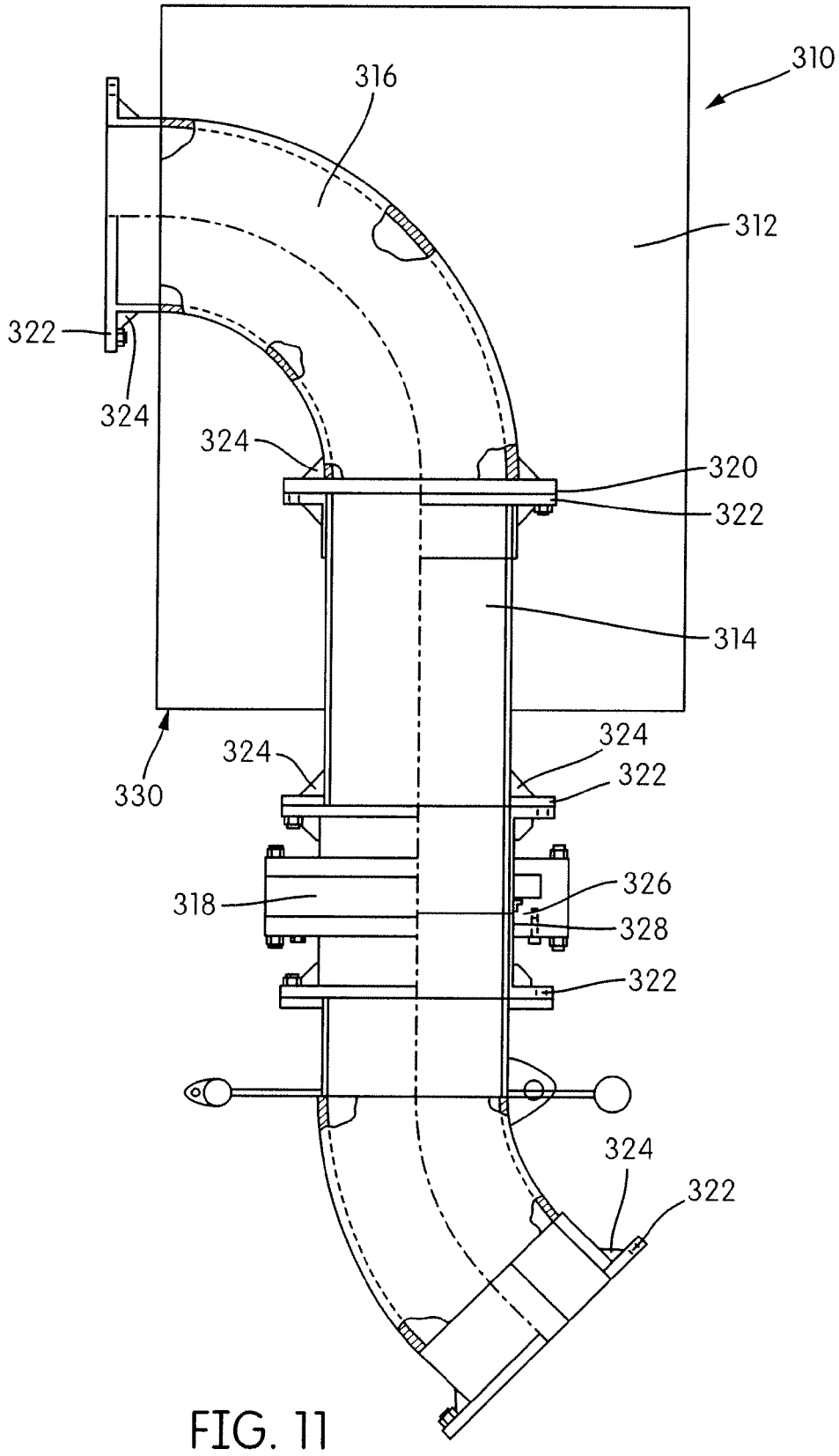
FIG. 11 is a side partial sectional view of a mooring buoy assembly according to another exemplary embodiment.

Referring now to FIG. 11, a mooring buoy assembly 310 includes a floating structure in the form of a pontoon 312, a pipe 314, an elbow 316, and a swivel joint in the form of a turning gland 318, similar to the mooring buoy assembly 110 of FIG. 4, but with some differences. The elbow 316 is connected to the pipe 314 via a flange coupling 320. Flanges 322 on the pipe 314 and other components are buttressed with gussets 324. Additionally, the interior of the turning gland 318 is shown in FIG. 11 to include a thrust bearing 326 (e.g., plain bearing that is axially constrained, annular roller bearing, ball bearing), configured to allow an end of the elbow 316 to freely rotate about the center of the elbow's other leg. The turning gland 318 further includes a seal 328 configured to constrain the flow path during rotation of the upper part of the turning gland 318.

In some embodiments, the pontoon 312 has buoyancy sufficient to float the elbow 316 only partially above water and the elbow is configured to directly receive a floating hose (see, e.g., floating hose 118 as shown in FIGS. 1-2) without raising the floating hose out of the water or changing the direction of the flow path from the floating hose prior to connecting to the elbow 316. For example, in some embodiments the pontoon 312 has a buoyancy rate of over 4000 lbs/ft-length, resulting in a buoyancy of over 40,000 lbs (e.g., 41,000 lbs) for the 8 ft×8 ft×10 ft embodiment disclosed above, which is sufficient to lift the mooring buoy assembly 310, estimated to weigh about 30,000 lbs including the submerged hose while the mooring buoy assembly 310 is actively communicating fluid at a sea depth of less than 40 feet. In such a hypothetical scenario, the buoyancy is sufficient to lift the inlet to the elbow 316 only about halfway above the surface of the water. As such, fluid flowing from the vessel through the mooring buoy assembly 310 changes direction less than with other buoys that elevate the floating hose and then turn the fluid more than 90-degrees (see generally FIG. 12), which is believed to reduce head loss in the fluid for the mooring buoy assembly 310.

According to an exemplary embodiment, the turning gland 318 is positioned under the pontoon 312 (i.e., along a portion of the flow path extending from the bottom 330 of the pontoon 312) and is in fluid communication with the elbow 316. In addition, the turning gland 318 is configured to be coupled to a submerged hose coupled to the pipeline (see, e.g., submerged hose 128 and pipeline 120 as shown in FIGS. 1-2). In some such embodiments, the turning gland 318 is configured to allow the elbow 316, the pontoon 312, and the floating hose to rotate relative to the submerged hose such that the floating hose may be drawn in the direction of a current. The vessel may then approach the floating hose with a bow of the vessel oriented into the current to engage the mooring buoy assembly 310, similar to the mooring buoy assembly 110 disclosed above.

Figure 12:
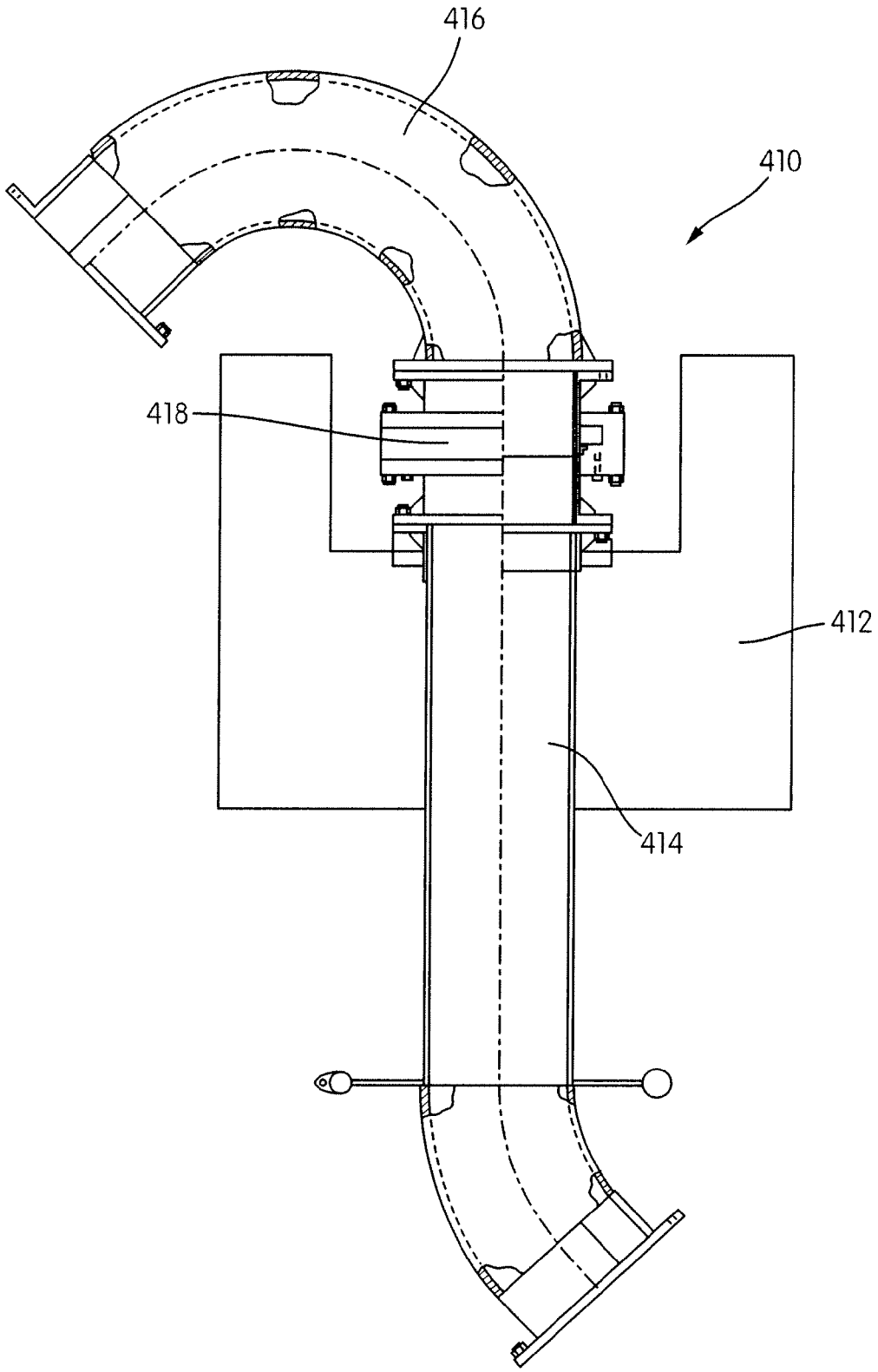
FIG. 12 is a side partial sectional view of a mooring buoy assembly according to yet another exemplary embodiment.

FIG. 12 depicts a mooring buoy assembly 410 according to another exemplary embodiment. The mooring buoy assembly includes a floating structure in the form of a pontoon 412, a pipe 414, an elbow 416, and a swivel joint in the form of a turning gland 418, similar to the mooring buoy assemblies 110, 310 of FIGS. 4 and 11. As with the mooring buoy assemblies 110, 310 of FIGS. 4 and 11, the pipe 414 of the mooring buoy assembly 410 of FIG. 12 the pipe 414 extends vertically into and away from the pontoon 412. The pipe 414 is fixed to the pontoon 412 such that the pontoon 412 does not rotate with respect to the pipe 414. Furthermore, the pipe 414 is configured to provide a flow path in fluid communication with a submerged hose (see, e.g., submerged hose 128 and pipeline 120 as shown in FIGS. 1-2).

The elbow 416 of the mooring buoy assembly 410 of FIG. 12 is supported by the pontoon 412, is in fluid communication with the pipe 414, and provides a change in direction of the flow path, similar to the mooring buoy assemblies 110, 310 of FIGS. 4 and 11. The elbow 416 is configured to be in fluid communication with a floating hose (see, e.g., floating hose 118 as shown in FIGS. 1-2). In addition, the turning gland 418 of the mooring buoy assembly 410 of FIG. 12 is connected to the pipe 414 and is configured to allow the elbow 416 and floating hose to rotate relative to the submerged hose, similar to the mooring buoy assemblies 110, 310 of FIGS. 4 and 11.

The turning gland 418 is spaced apart from the pontoon 412 by the pipe 414. As such, the turning gland 418 may be more readily installed and accessed during manufacturing, or more easily repaired and replaced during operation. However, unlike the mooring buoy assemblies 110, 310 of FIGS. 1 and 11, the mooring buoy assembly 410 of FIG. 12 includes the turning gland 418 above the pontoon 412, on the same side of the pontoon 412 as the elbow 416. As such, the pontoon 412 is part of the "fixed" portion of the mooring buoy assembly 410 and does not freely rotate relative to the submerged hose.

Furthermore, unlike the mooring buoy assemblies 110, 310 of FIGS. 4 and 11, the elbow 416 of the mooring buoy assembly 410 extends from the top of the pontoon 412, turns more than ninety degrees (e.g., about 45-degrees more), and does not include an opening (e.g., inlet) that is only partially above the waterline. Instead, the floating hose connected to the mooring buoy assembly 410 extends upward to connect to the opening of the elbow 416. By contrast, the elbow 124 of the mooring buoy assembly 110 of FIG. 4 only turns about ninety degrees, which requires less change in momentum of the fluid flowing through the mooring buoy assembly 110 relative to the mooring buoy assembly 410, and is believed to be correspondingly more efficient.

The construction and arrangements of the mooring buoy assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. For example, in some embodiments, a mooring buoy assembly may be sold as a kit of parts disclosed herein, to be assembled by an end user. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A mooring buoy assembly, comprising:

a floating structure;

a pipe extending vertically into and away from the floating structure, wherein the pipe is fixed to the floating structure such that the floating structure does not rotate with respect to the pipe, and wherein the pipe is configured to provide a flow path in fluid communication with a submerged hose;

an elbow in fluid communication with the pipe and providing a change in direction of the flow path, and wherein the elbow is supported by the floating structure and configured to be in fluid communication with a floating hose; and a swivel joint connected to the pipe, the swivel joint positioned below the floating structure and configured to allow the elbow and floating hose to rotate relative to the submerged hose.

2. The mooring buoy assembly of claim 1, wherein the floating structure comprises a pontoon.

3. The mooring buoy assembly of claim 2, wherein the swivel joint is physically separated from the pontoon by the pipe.

4. The mooring buoy assembly of claim 3, wherein the swivel joint is on a side of the pontoon that is opposite to the elbow.

5. The mooring buoy assembly of claim 1, wherein the swivel joint comprises a turning gland in fluid communication with the pipe and the elbow, wherein the turning gland comprises:

a thrust bearing configured to allow an end of the elbow to rotate; and a seal configured to seal the flow path during rotation.

6. A mooring buoy assembly configured for connecting a vessel to a pipeline for communication of fluid, comprising:

a pontoon;

an elbow supported by the pontoon and having an arcuate flow path, wherein the elbow is configured to be coupled to a floating hose for connecting to the vessel; and a turning gland positioned under the pontoon, wherein the turning gland is in fluid communication with the elbow and is configured to be coupled to a submerged hose coupled to the pipeline;

wherein the turning gland is configured to allow the elbow, the pontoon, and the floating hose to rotate relative to the submerged hose, whereby the floating hose may be drawn in the direction of a current such that the vessel may approach the floating hose with a bow of the vessel oriented into the current to engage the mooring buoy assembly.

7. The mooring buoy assembly of claim 6, further comprising a pipe extending between the turning gland and the elbow, wherein the pipe physically separates the turning gland from the pontoon.

8. The mooring buoy assembly of claim 7, wherein the pipe extends vertically into and away from the pontoon, wherein the pipe is fixed to the pontoon such that the pontoon does not rotate with respect to the pipe.

9. The mooring buoy assembly of claim 6, wherein the elbow is a first elbow and the turning gland is connected to a second elbow on a side of the turning gland that is opposite to the first elbow, and wherein the turning gland is configured to be coupled to the submerged hose by way of the second elbow.

10. The mooring buoy assembly of claim 9 wherein the first elbow changes the direction of flow by a greater angle than the second elbow changes the direction of flow.

11. The mooring buoy assembly of claim 10 wherein the turning gland is the only rotational bearing interface of the pipe.

12. The mooring buoy assembly of claim 6, wherein the elbow is fixed to and integrated with the pontoon.

13. The mooring buoy assembly of claim 6, wherein the submerged hose is coupled to the turning gland and wherein the floating hose is coupled to the elbow.

14. A mooring buoy assembly, comprising:

an elbow having an arcuate flow path, wherein the elbow is configured to be coupled to a floating hose;

a swivel joint in fluid communication with the elbow, wherein the swivel joint is configured to be coupled to a submerged hose, and wherein the swivel joint is configured to allow the elbow and the floating hose to rotate relative to the submerged hose; and a buoyant structure supporting the elbow, wherein the buoyant structure has buoyancy sufficient to float the elbow only partially above water, wherein the elbow includes a first opening configured to be coupled to the floating hose and a second opening configured to be coupled to the submerged hose by way of the swivel joint, and wherein the buoyant structure has buoyancy to float the elbow such that the first opening is only partially above water.

15. The mooring buoy assembly of claim 14, wherein the buoyant structure has buoyancy to float the elbow such that the first opening is about half above water and half below water.

16. The mooring buoy assembly of claim 14, wherein the elbow comprises about a ninety degree turn.

17. The mooring buoy assembly of claim 16, wherein the elbow turns the flow path no more than about ninety degrees.

18. The mooring buoy assembly of claim 14, wherein swivel joint is positioned under the buoyant structure.

19. The mooring buoy assembly of claim 18, further comprising a pipe extending between the swivel joint and the elbow, wherein the pipe physically separates the swivel joint from the buoyant structure.

20. A mooring buoy assembly, comprising:

a floating structure;

a pipe extending vertically into and away from the floating structure, wherein the pipe is fixed to the floating structure such that the floating structure does not rotate with respect to the pipe, and wherein the pipe is configured to provide a flow path in fluid communication with a submerged hose;

an elbow in fluid communication with the pipe and providing a change in direction of the flow path, and wherein the elbow is supported by the floating structure and configured to be in fluid communication with a floating hose; and a swivel joint connected to the pipe and configured to allow the elbow and floating hose to rotate relative to the submerged hose, the swivel joint comprising a turning gland in fluid communication with the pipe and the elbow, wherein the turning gland comprises:

a thrust bearing configured to allow an end of the elbow to rotate; and a seal configured to seal the flow path during rotation.

* * * * *